United States Patent [19]

Jordan, Jr.

[11] Patent Number: 4,984,301

[45] Date of Patent: Jan. 15, 1991

[54] SHOOTERS GLOVE

[76] Inventor: Joseph F. Jordan, Jr., 118 Merrifield Ct., Greenville, S.C. 29615

[21] Appl. No.: 355,903

[22] Filed: May 22, 1989

[51] Int. Cl.[5] ..... A41D 19/00

[52] U.S. Cl. ..... 2/161 A; 2/164

[58] Field of Search ..... 2/159, 163, 168, 161 A, 2/161 R, 164, 169, 16

[56] References Cited

U.S. PATENT DOCUMENTS

| | | | |
|---|---|---|---|
| 2,118,463 | 5/1938 | Eden | 2/163 |
| 2,728,082 | 12/1955 | Slimovitz | 2/167 |
| 3,881,197 | 5/1975 | Andrews | 2/161 A |
| 4,590,626 | 5/1986 | Chen | 2/161 A X |
| 4,712,253 | 12/1987 | Chen | 2/159 |
| 4,741,052 | 5/1988 | Rubin | 2/161 A |

FOREIGN PATENT DOCUMENTS

| | | | |
|---|---|---|---|
| 466408 | 5/1937 | United Kingdom | 2/168 |
| 1252680 | 11/1971 | United Kingdom | 2/161 A |

*Primary Examiner*—Werner H. Schroeder
*Assistant Examiner*—Sara M. Current
*Attorney, Agent, or Firm*—Dority & Manning

[57] ABSTRACT

A glove is generally insulated except the thumb and forefinger, enabling a person such as a policeman to operate a pistol without removal of the glove. The glove includes a hand covering having a main body and further consisting of five separate finger stalls, which permits the glove to be worn normally full time like a conventional glove, while at the same time permitting operations generally involving relative manual dexterity, such as involving opposing-appendage grasping operations, or trigger or button actuation operations.

4 Claims, 1 Drawing Sheet

SHOOTERS GLOVE

BACKGROUND OF THE INVENTION

The present invention is generally directed to an improved glove, and more particularly concerns a mostly insulated glove with tight fitting index finger and thumb stalls for performance of manual operations with relative dexterity while wearing such gloves.

Certain occupations require relatively long-term exposure to the elements, such as cold and/or wet weather, yet simultaneously require the person to be prepared to undertake activities (sometimes immediately and on little notice) involving manual dexterity. One prime example of such circumstances is that of a policeman who is outdoors during cold weather, but must immediately have access to, and operate, a firearm. Any hesitancy in being able to draw or operate a firearm can literally result in harm (or fatal injury) to the officer, or to innocent public bystanders.

U.S. Pat. No. 4,741,052 issued to Rubin relates to a hand covering for use with firearms. A glove or mitten is provided with insulation generally, but is further provided with a separate uninsulated trigger finger stall to facilitate operation of a firearm. The Rubin hand covering is in fact preferably provided with two separate trigger finger receiving stalls, one being provided with normal insulation, and the other with no insulation for a tighter fit. One chief, and potentially critical, disadvantage of such a hand covering is that the user must transfer his or her trigger finger from the insulated trigger finger stall to the uninsulated trigger finger stall. Thus, a finite amount of time is required, involving partial withdrawal of the user's hand from the glove, and reinsertion so as to have the trigger finger received in the appropriate stall. Accordingly, such a six-fingered glove or modified mitten does not permit full time immediate safe operation of a firearm.

In general, the Rubin Patent recognizes that the bulkiness of an insulated trigger finger stall may cause accidental discharge of the firearm as the user works his or her finger into the trigger part of the gun. However, such very limited contribution to the art fails to facilitate safe operation of a firearm at a moments notice, and fails to address other disadvantages which generally accompany the wearing of bulky winter or insulated gloves.

SUMMARY OF THE INVENTION

The present invention recognizes and addresses the above-briefly discussed drawbacks and others, of prior art insulated gloves. Accordingly, the general object of this invention is to provide an improved glove which facilitates operations involving manual dexterity. A more particular object is to provide a generally insulated glove with uninsulated thumb and index finger stalls for improved manual operations, such as safe operation of a firearm.

Another general object is to provide an improved shooters glove. Another broader object of this invention is to provide an improved policeman's glove, such as for improved shooting, reloading, writing, and microphone-use, etc. operations.

Another more specific present object is to provide an improved shooters glove having a tight fitting thumb and forefinger, to allow the wearer to use a firearm at a moments notice without struggling with the bulkiness of conventional insulated gloves (which are typically insulated, i.e. bulky, everywhere).

Yet another general object to this invention is to provide a generally insulated glove, wherein the thumb portion thereof is not insulated, which further facilitates gripping operations, such as changing of individual bullets, operation of a magazine release, or other operations requiring dexterity of a given hand, or opposing or grasping fingers.

Additional objects and advantages of the invention are set forth, or will be apparent to those of ordinary skill in the art, from the detailed description which follows. Also, it should be appreciated that modifications and variations to the specific illustrated and discussed features hereof may be practiced in various embodiments and uses of this invention without departing from the spirit and scope thereof, by virtue of present reference thereto. Such variations may include, but are not limited to, substitution of equivalent features and means for those shown or discussed, and the reversal of various constructions, or the like. Use of various shell (i.e., exterior) and lining (i.e., interior) materials is also within the field of choice to those of ordinary skill in the art.

Still further, it is to be understood that different embodiments, as well as different presently preferred embodiments, of the present invention may include various combinations of presently disclosed features, or their equivalents. One exemplary such embodiment of the present invention relates to a generally insulated glove for providing general warmth and specific dexterity for the wearer. Such glove may comprise an insulated covering for the hand consisting of five separate finger stalls adapted for corresponding insertion thereinto of the five fingers of a wearer's hand. Generally all portions of such covering are preferably insulated except for two of the finger stalls adapted for insertion of a wearer's index finger and thumb, respectively. With such construction, the dexterity of the wearer's grasp is improved by a relative tight fit of the thumb and index finger in their respective uninsulated finger stalls.

Another present exemplary embodiment concerns an insulated police glove for improved manual operations, such as safe operation of a firearm. Such a construction may comprise a hand covering having a main body for covering the palm and back of a user's hand, and having five finger stalls integrally attached with the main body. Such stalls are preferably adapted for respective receipt of the five fingers of a user's hand, including the user's thumb, forefinger, middle finger, ring finger, and small finger of a given hand. With such a construction, the main body and finger stalls adapted for receipt of a user's middle, ring, and small fingers of a given hand, preferably include a layer of insulation for added warmth and protection of the user's hand. Also, the finger stalls adapted for receipt of a user's thumb and forefinger of such given hand are preferably not provided with a layer of insulation, but instead are adapted for relatively tight fits with such fingers for improved manual grasping operations therewith.

Yet another construction comprising a present exemplary embodiment includes a hand covering for a shooter, comprising a glove having plural finger stalls including two separate stalls for respective receipt of the thumb and forefinger of a user's hand whenever the glove is worn on such hand. With such construction, preferably the glove is generally insulated, except the separate thumb and forefinger finger stalls thereof, to provide warmth generally to the user's hand while facilitating use of a handgun therewith.

With each of the foregoing constructions, further wrist band adjustment means may be practiced for adjustably tightening the glove about the wrist of a user's hand. Also, the various construction may be adapted for use with either a user's right or left hand.

Those of ordinary skill in the art will better appreciate the features and aspects of such embodiments, and others, upon review of the remainder of the specification.

BRIEF DESCRIPTION OF THE DRAWINGS

A full and enabling disclosure of the present invention, including the best mode thereof, directed to one of ordinary skill in the art, is set forth in the remainder of the specification, which makes reference to the appended figures, in which.

Figure 1:
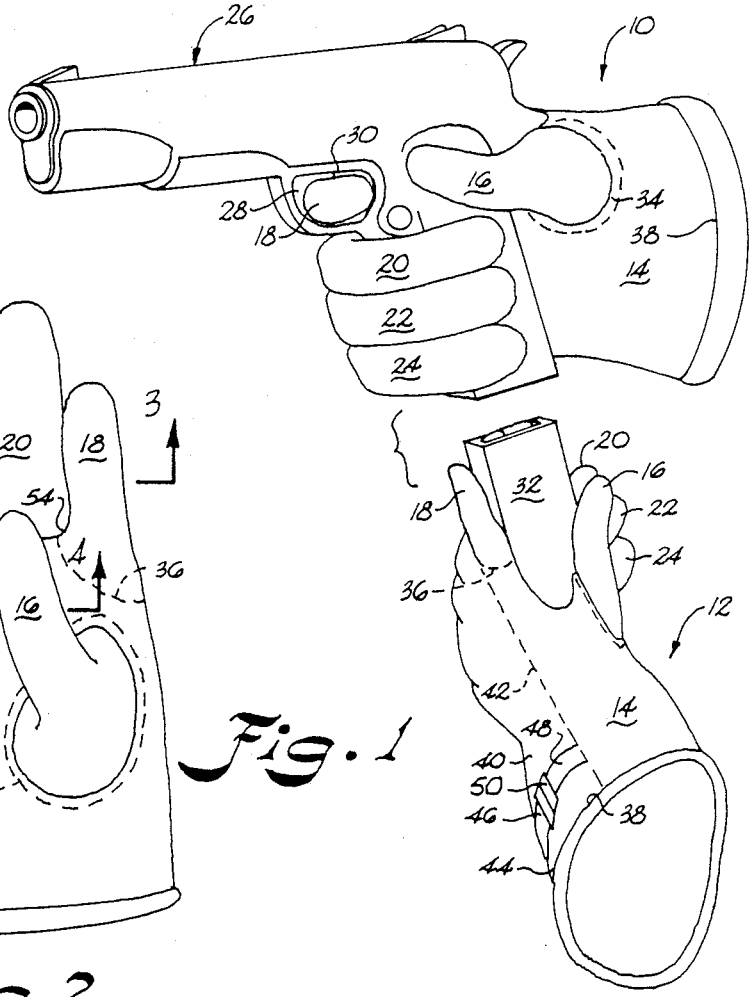
FIG. 1 is a plan view of an exemplary embodiment of the present invention illustrating use thereof with a firearm and magazine therefor.

Repeat use of reference characters throughout the present specification and appended drawings is intended to represent same or analogous features or elements of the invention.

DETAILED DESCRIPTION OF THE PREFERRED EMBODIMENT

Those of ordinary skill in the art will appreciate the broader aspects of the present invention disclosed herewith, which are not limited solely to the features of the exemplary preferred embodiment discussed hereinafter with reference to the accompanying drawings.

FIG. 1 illustrates a pair of gloves, generally 10 and 12, provided in accordance with the present invention. Preferably, such gloves are generally similar in nature and construction, except that glove 10 is adapted to be worn on the right hand of a user, while glove 12 is adapted to be worn on the left hand of a user. Each glove of the preferred embodiments illustrated includes a main body 14 and five finger stalls integrally attached thereto. The five finger stalls are respectively adapted for receipt of the five fingers of a user's hand. Each glove preferably includes a stall 16 for receipt of a user's thumb, a stall 18 for the forefinger or trigger finger, a stall 20 for the middle finger, a stall 22 for the ring finger, and a stall 24 for the small finger, of each given hand. Of course, those of ordinary skill in the art will understand that illustration of such "stalls" in present FIG. 1 in fact is an illustration of the exterior of each portion of the glove corresponding with such finger stalls. If desired, finger stalls 20, 22, and 24 could be grouped together in a given embodiment in a mitten-like embodiment.

In FIG. 1, an automatic weapon or handgun 26 may include a trigger area 28, a trigger 30, and a bullet magazine or clip 32. As well understood, insertion of the index or forefinger 18 into trigger area 28 permits selected operation (i.e., actuation) of trigger 30 for discharging firearm 26. In accordance with the present invention, the thumb and index finger of a user's hand form a relatively tight fit with finger stalls 16 and 18, which are preferably uninsulated. In other words, such finger stalls are formed with relatively tight fitting material, such as a leather-based exterior shell which forms a preferred portion of each hand covering in accordance with the present invention.

As also understood by those of ordinary skill in the art, a release button or the like on the thumb side of firearm 26 may be provided for operation in order for removal of magazine or clip 32, the replacement of which permits reloading of the firearm. A thick or insulated thumb would not permit the user to be able to feel where such button is, and in fact, determine whether such button was actuated. Hence, a glove constructed in accordance with the present invention permits immediate operation of firearm 26, without any removal or re-positioning (partially or totally) of the glove, regardless of whether firing or reloading operations are involved. The same advantages are true for other possible operations, such as releasing a safety, unstrapping a holster cover, or the like.

Such advantages are offered even with the use of different types of firearms. For example, use of a speed loader involves gripping of the speed loader itself with the thumb and index finger, all of which manual operations are considerably enhanced and facilitated with use of the present invention. Operation of a revolver can also involve actuation of a cylinder release, which again requires the use of the user's thumb and the ability to feel operation of the release itself. Obviously, all such advantages apply to operation of various firearms (pistols, rifles, etc.) generally, and are in no way limited to the automatic handgun presently represented out of convenience only.

In addition to the foregoing advantages of providing a generally insulated glove with uninsulated and tight fitting thumb and forefinger stalls, other manual operations not involving firearms are facilitated. For example, use of a pencil or other writing instrument is greatly enhanced. Similarly, use of a microphone or the buttons of a telephone or other pieces of electronic equipment are improved. Any grasping, gripping, or manual operations generally are improved, while at the same time not requiring removal or re-positioning of the hand of the user. Hence, such constructions prove invaluable to operators or user's who must perform in cold and/or wet weather conditions. At the same time, the glove such as in accordance with the presently disclosed preferred embodiment, is water proof and warm for the protection of the hands of the user.

FIG. 1 further shows various seam lines which facilitate manufacture of gloves constructed in accordance with the present exemplary embodiment. For example, the base of thumb stall 16 may be surrounded with a generally continuous seam 34, permitting the thumb stall (preferably uninsulated) to be sewn on or integrally attached to the glove, but separate from the otherwise insulated portions thereof. Similarly, the base portion of forefinger stall 18 may be surrounded with seam lines, such as seam line 36, much for the same reasons as using seam line 34. A reinforcing seam line 38 may be provided adjacent a wrist portion of the glove, for the general durability of the glove.

To further enhance and render practical a glove constructed in accordance with this invention, wrist band adjustment means 40 may be provided, such as between a pair of seam lines, such as 42 and 44. Adjustment means 40 permits the covering 14 to be adjustably tightened about the wrist of the wearer's hand. Such means may include a pair of belt members or the like 46 and 48, the relative tightness of which is adjusted with a buckle 50. Straps or other equivalents may be substituted for various features of adjustment means 40.

Figure 2:
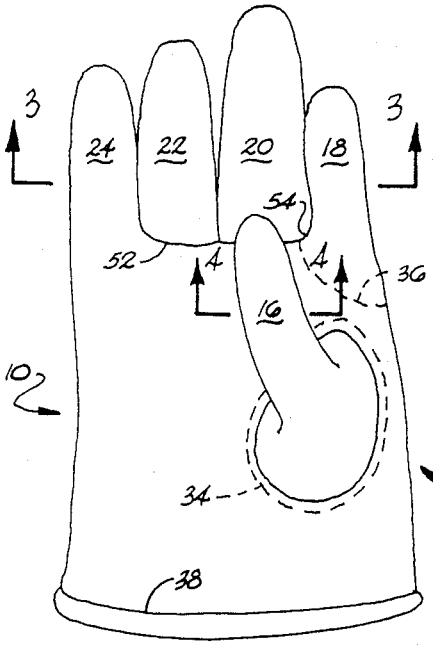
FIG. 2 is a side view of one of the gloves of the exemplary embodiments represented in FIG. 1.

FIG. 2 illustrates a side view, looking at the palm, of an exemplary right-hand glove 10 in accordance with the present invention. In addition to the above-discussed features marked with reference characters in FIG. 2, further seam lines 52 and 54 are shown in association with the base of finger stalls 22 and 20, respectively. Those of ordinary skill in the art will appreciate that practice of the present invention is not limited to a particular combination of seamed pieces or seam locations as illustrated by way of example only in the presently preferred embodiment. Rather, a number of variations and modifications may be practiced, without departing from the broader spirit and scope of the present invention which is directed to provision of a generally insulated glove having a relatively tight fitting thumb and forefinger to permit improved manual dexterity in a generally insulated product.

Figure 3:
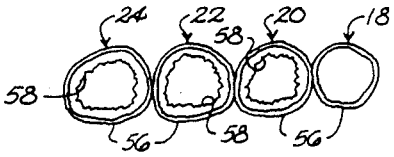
FIG. 3 is a cross-sectional view of four finger stalls of the embodiment of present FIG. 2, taken along the line 3—3 indicated therein.
Figure 4:
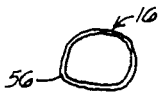
FIG. 4 is a cross-sectional view of the thumb finger stall of the exemplary embodiment of present FIG. 2, taken along the line 4—4 indicated therein.

Also, FIG. 2 has been provided for establishing sections lines for FIG. 3 and FIG. 4, respectively, as indicated by lines 3—3 and 4—4 therein. In particular, FIG. 3 illustrates a cross-section of the various finger elements relating to finger stalls 18, 20, 22, and 24. As will be understood by those of ordinary skill in the art, such finger stalls are preferably adapted for receipt of the forefinger, middle finger, ring finger, and small finger, respectively, of a user's given hand. FIG. 4 illustrates a cross-section of a finger stall 16 adapted for receipt of a user's thumb of such given hand.

As is represented in present FIGS. 3 and 4, all such five stalls are formed by the exterior or shell portion 56 of glove 10. However, in accordance with the present invention, finger stalls for the thumb and forefinger (stalls 16 and 18, respectively) do not have insulation provided therein, while the other three finger stalls do have insulation, generally 58. Those of ordinary skill in the art will appreciate that a hand covering may be provided in accordance with the present invention which provides separate, uninsulated stalls for receipt of the user's thumb and forefinger, without necessarily providing separate stalls for respective receipt of the other three fingers of a user's given hand. In other words, a half mitten or mitten-type style may be provided in accordance with the present invention, generally so long as the thumb and forefinger are provided with a relatively tight fit between such fingers and the shell portion 56 defining each such stalls.

Obviously, different size gloves or the like may be provided in accordance with presently disclosed features. Likewise, practice of the present invention is also not limited to use of any particular materials. Either man-made or natural materials may be used, as desired. In one preferred embodiment, shell 56 may be provided as a leather-based exterior, such as deer skin or the like. Such material particularly provides excellent tactile feedback between the fingers and the object being grasped, manipulated, or actuated. The lining may be other materials, such as rabbit fur, or various man-made materials.

In brief summary, the present invention provides general warmth and protection to a wearer's hand (or hands), without requiring removal or re-positioning of the glove to permit various manual operations requiring relative dexterity, such as safe operations of a firearm. While a glove such as in accordance with the presently preferred exemplary embodiment is particularly well suited for winter wear by a policeman or the like, practice of the present invention is not limited to such use. For example, hunters, outside construction workers operating triggerable equipment such as large drills, or surveyors operating delicate instruments with fine focusing knobs, are further examples of users who would benefit from the advantages provided by the present invention.

It is to be further understood that all variations and modifications which would occur to one of ordinary skill in the art without departing from the spirit and scope of this invention, are intended to come within the scope of such invention by virtue of present reference thereto. Likewise, the foregoing exemplary description of the presently preferred embodiment is by way of example only, and is not intended to limit the present invention, which is set forth in its broader terms in the appended claims.

What is claimed is:

1. An insulated police glove for improved manual operations such as safe operation of a firearm, said glove comprising:

a hand covering having a main body for covering the palm and back of a user's hand, and having only five finger stalls integrally attached with said main body, which stalls are adapted for respective receipt of the five fingers of a user's give hand, including the user's thumb, forefinger, middle finger, ring finger, and small finger of a give hand; wherein a layer of insulation is formed fully in and only in said main body and said finger stalls adapted for receipt of a user's middle, ring, and small fingers of a give hand, for added warmth and protection of the user's hand; so that said finger stalls adapted for receipt of a user's thumb and forefinger of such given hand do not have a layer of insulation, but instead form relatively tight fits with such thumb and forefinger for improved manual grasping operations therewith; and further wherein said covering includes an exterior leather-based shell and said insulation comprises thermal insulation, so that said glove maximizes warmth protection for the user's hand while minimizing bulkiness thereof for safe operation of a firearm without requiring repositioning of such glove for firearm operations.

2. A glove as in claim 1, further including wrist band adjustment means for adjustably tightening said hand covering about the wrist of a user's hand.

3. A glove as in claim 1, wherein said hand covering is adapted for use with a user's right hand.

4. A glove as in claim 1, wherein said hand covering is adapted for use with a user's left hand.

* * * * *

UNITED STATES PATENT AND TRADEMARK OFFICE

CERTIFICATE OF CORRECTION

PATENT NO. : 4,984,301

DATED : January 15, 1991

INVENTOR(S) : Joseph F. Jordan, Jr.

It is certified that error appears in the above-identified patent and that said Letters Patent is hereby corrected as shown below:

Column 6, claim 1, line 36, change "give" to --given--;
line 38, change "give" to --given--.

Signed and Sealed this

Nineteenth Day of May, 1992

*Attest:*

DOUGLAS B. COMER

*Attesting Officer*

*Acting Commissioner of Patents and Trademarks*